US007017589B1

(12) United States Patent
Minnelli

(10) Patent No.: US 7,017,589 B1
(45) Date of Patent: Mar. 28, 2006

(54) SELF-CONCEALING SYSTEM FOR PROVIDING AN ENHANCED, ELEVATED AND FULLER APPEARANCE FOR A PONYTAIL

(76) Inventor: Mia Minnelli, 1770 Broadway #101, San Francisco, CA (US) 94109

( * ) Notice: Subject to any disclaimer, the term of this patent is extended or adjusted under 35 U.S.C. 154(b) by 357 days.

(21) Appl. No.: 10/394,124

(22) Filed: Mar. 21, 2003

(51) Int. Cl.
*A41G 3/00* (2006.01)
*A41G 5/00* (2006.01)

(52) U.S. Cl. ..... 132/201

(58) Field of Classification Search ..... 132/273, 132/55, 276, 278, 201, 200, 275, 277
See application file for complete search history.

(56) References Cited

U.S. PATENT DOCUMENTS 754,206 A * 3/1904 Edgar ..... 132/106
2,847,016 A 8/1958 Rabinowitz ..... 132/48
6,135,125 A 10/2000 Sartena ..... 132/275
6,276,368 B1 8/2001 Giamalva ..... 132/201
6,311,699 B1 11/2001 Horman ..... 132/278
6,318,379 B1 11/2001 Droin ..... 132/273

* cited by examiner

*Primary Examiner*—John J. Wilson
*Assistant Examiner*—Robyn Doan
(74) *Attorney, Agent, or Firm*—Goldstein Law Offices PC.

(57) ABSTRACT

A system for creating an enhanced ponytail, the ponytail bound with a tie to create a root portion adjacent to the scalp and a ponytail extending rearwardly from the tie, using a device having a front, a rear, a roof portion having front and rear arches at the front and rear, and a comb extending downward from the roof portion at and parallel to the front. The ponytail is apportioned into an upper selected portion and a lower remainder portion. The selected portion is inverted adjacent to the tie to extend forwardly across the tie, the comb is inserted downward through the inverted selected portion and into the root portion just forward of the tie, and the inverted selected portion is once again inverted to extend rearwardly over the roof portion, concealing the device and tie, and rejoining with the remainder portion.

13 Claims, 5 Drawing Sheets

SELF-CONCEALING SYSTEM FOR PROVIDING AN ENHANCED, ELEVATED AND FULLER APPEARANCE FOR A PONYTAIL

BACKGROUND OF THE INVENTION

The invention relates to a self-concealing system for providing a higher and fuller appearance for a ponytail. More particularly, the invention relates to a system that works in conjunction with a pony tail, and invisibly manipulates the hair forming said pony tail, to prop up the pony tail and provide a fuller overall appearance for the same.

Despite the multitude of hairstyles promulgated over the years, the 'ponytail' has persisted in one form or another throughout. Probably because it is a way to neaten the hair rather quickly, the ponytail has everlasting popularity. Commonly the ponytail is a collection of hair that is bound with a ribbon, tie, or rubber band.

Depending on how tightly the hair is gathered, where on the head the hair is bound, and how it is bound, the ponytail can be made to drape in a variety of ways. In most cases, however, the ponytail generally extends outward and downward from the head. One style of wearing the ponytail which was extremely popular in the 1950's was to wear the pony tail so that it is 'propped up', whereas the ponytail seem to extend upward before draping downward. Achieving this look involved bending a portion of the hair rearward of the tie so that it extends forward, clipping the hair, and then allowing it to extend rearward over the rest of the ponytail. Unfortunately, reliably achieving this appearance was not easy, and required several 'bobby pins' or clips and also considerable time. Now, as this ponytail style has returned to favor, there is a renewed opportunity to provide the desired appearance in an easy and reliable manner.

Various devices have been proposed which seek to enhance the appearance or wearability of the ponytail for the user, would not aid the purposes of the present invention. For example, U.S. Pat. No. 2,847,016 to Rabinowitz discloses a ponytail hair clasp and ornament. U.S. Pat. No. 6,311,699 to Horman discloses a ponytail holder that clamps the hair within a cylindrical structure. U.S. Pat. No. 6,135,125 to Sartena and U.S. Pat. No. 6,276,368 to Giamalva both disclose devices that allow the formation of unusual hairstyles with groups of hair. U.S. Pat. No. 6,318,379 to Droin discloses a comb-like element for holding the hair. U.S. Pat. No. 5,842,484 to Longsworth discloses a hair fashion accessory that facilitates holding the hair and attachment of a bow to the hair.

My previous United States Patents disclose system for holding ponytails that provide an unobtrusive natural appearance. These devices do not, by themselves, allow the desired ponytail style to be achieved, but may be suitable for use as the 'tie' as described hereinafter.

Accordingly, while these units may be suitable for the particular purpose employed, or for general use, they would not be as suitable for the purposes of the present invention as disclosed hereafter.

SUMMARY OF THE INVENTION

It is an object of the invention to provide a system that enhances the appearance of a ponytail by elevating the ponytail and giving it a fuller appearance before it drapes downward. Accordingly, the present invention involves selecting, bending, and lifting a portion of the hair that is already formed into a ponytail using a conventional tie so that the selected portion extends momentarily forward over the tie, and then securing the inverted selected hair with a device which anchors within the ponytail root to secure through the inverted ponytail, hold the selected folded hair down against the root portion, and then once again allows the selected hair to reverse and extend rearwardly and upwardly over the device to provide a fuller, elevated, and enhanced appearance.

It is another object of the invention to provide a system that employs a device that is self-concealing. Accordingly, after a portion of the ponytail is inverted, and the device is inserted in the root portion and inverted hair, the inverted hair is draped over the device, concealing the device as well as partially or fully concealing the tie used to form the ponytail, and blending with the remaining, unselected portion of the ponytail.

It is an object to provide a system that is easy to use. Accordingly, the device is configured to easily anchor within the hair in the midst of a simple procedure for creating the desired effect.

It is a further object of the invention to provide a device that is inexpensive to manufacture. Accordingly, the device is configured so that it may be manufactured in a single piece, providing enhanced structural integrity as well.

The invention is a system for creating an enhanced ponytail, the ponytail bound with a tie to create a root portion adjacent to the scalp and a ponytail extending rearwardly from the tie, using a device having a front, a rear, a roof portion having front and rear arches at the front and rear, and a comb extending downward from the roof portion at and parallel to the front. The ponytail is apportioned into an upper selected portion and a lower remainder portion. The selected portion is inverted adjacent to the tie to extend forwardly across the tie, the comb is inserted downward through the inverted selected portion and into the root portion just forward of the tie, and the inverted selected portion is once again inverted to extend rearwardly over the roof portion, concealing the device and tie, and rejoining with the remainder portion.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
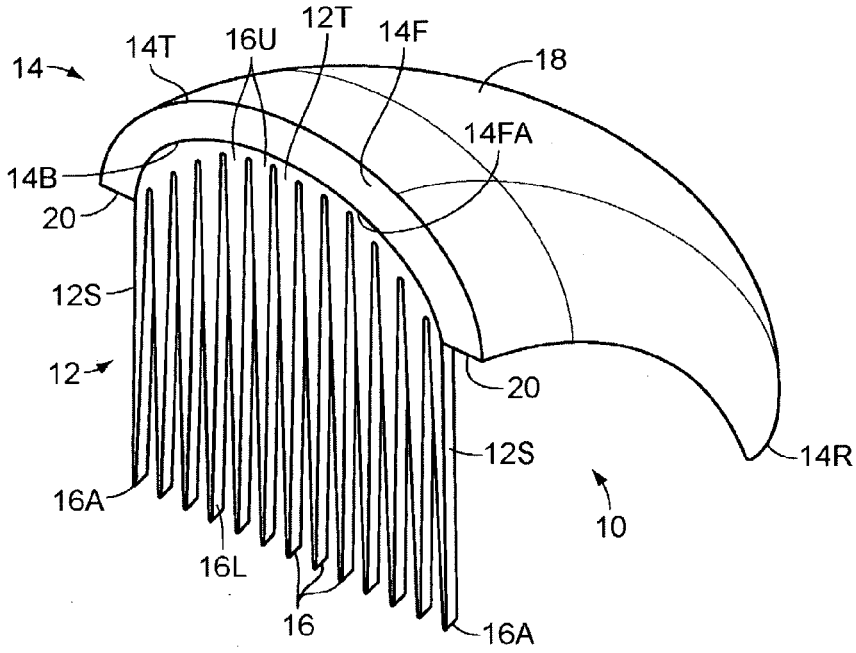
FIG. 1 is a diagrammatic perspective view, illustrating the ponytail enhancing device according to the present invention, per se.
Figure 2:
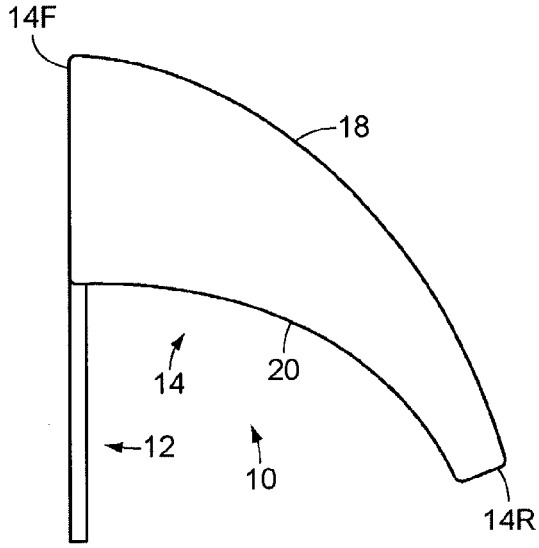
FIG. 2 is a side elevational view thereof, illustrating the downward contour of the roof portion thereof.

FIG. 1 illustrates a pony tail enhancing device 10 according to the present invention, comprising a comb 12 and a roof portion 14. The comb has a plurality of teeth 16 which have a lower end 16L and are joined at an upper end 16U. Referring momentarily to FIG. 2, the roof portion 14 has a front 14F and a rear 14R. The comb 12 extends downward at the front 14F, substantially parallel to said front 14F.

Referring again to FIG. 1, the roof portion 14 has a top 14T and a bottom 14B, defining a thickness which is substantially consistent between the front 14F and rear 14R to provide structural strength to the enhancing device 10. The comb 12 has a pair of comb sides 12S where a pair of outermost teeth 16A are located, and a comb top 12T that extends substantially to the bottom 14B of the front arch 14F. As illustrated, the teeth 16 are substantially even at the lower end 16L, but closely follow the contour of the roof forward arch 14FA at their upper ends 16U.

Figure 3:
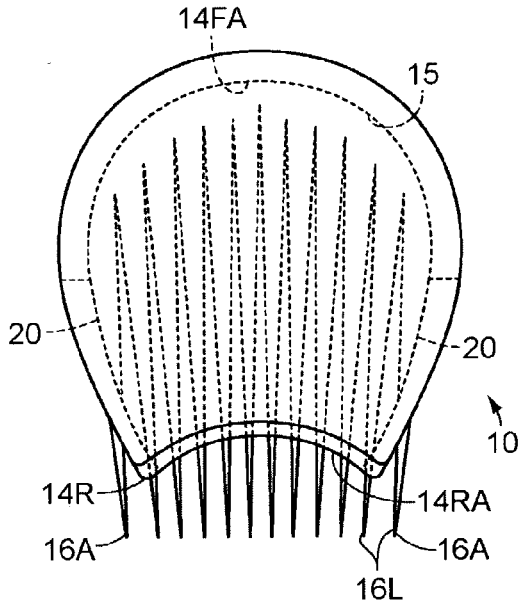
FIG. 3 is a rear elevational view, illustrating the teeth partially protruding below the rear arch, and illustrating in hidden lines how the teeth extend nearly fully to the forward arch of the roof portion.

FIG. 3 illustrates a rear arch 14RA at the rear 14R of the roof portion 14. The rear arch 14RA is near the lower end 16L of the teeth, and is illustrated as extending just above the lower end 16L of the teeth. A channel 15 is created between the rear arch 14RA and forward arch 14FA, which is wider and deeper at the front arch 14FA.

Referring to FIG. 1 and FIG. 2, the roof portion 14 has a pair of longitudinally extending outer lower edges 20, and an apex 18 extending longitudinally therebetween. The outer lower edge 20 extends alongside the outermost teeth 16A of the comb 12 at the front 14F. The apex 18 and outer lower edges 20 are both curved downward between the front 14F and rear 14R. As best seen in FIG. 2, the apex 18, however, is curved downward at a tighter radius than the outer lower edges 20 so that the apex 18 and outer edges 20 are vertically closer together at the rear 14R than at the front 14F.

As seen in FIG. 3, the outer lower edges 20 are tapered transversely inwardly so that at the rear 14R, the lower edge 20 extends inwardly of the comb sides 12S, and inwardly of the outermost teeth 16A thereof. Accordingly, the rear arch 14RA is shallower, having a larger radius of curvature between the outer lower edges 20, and transversely shorter in length than the forward arch 14FA. Thus, the channel 15 is wider and deeper at the front arch 14FA than at the rear arch 14RA.

Now that the ponytail enhancing device 10 has been described in substantial structural detail, the manner in which the device 10 is used to create a desired ponytail hairstyle is described in detail hereinafter with reference to FIG. 4 through FIG. 7.

Figure 4:
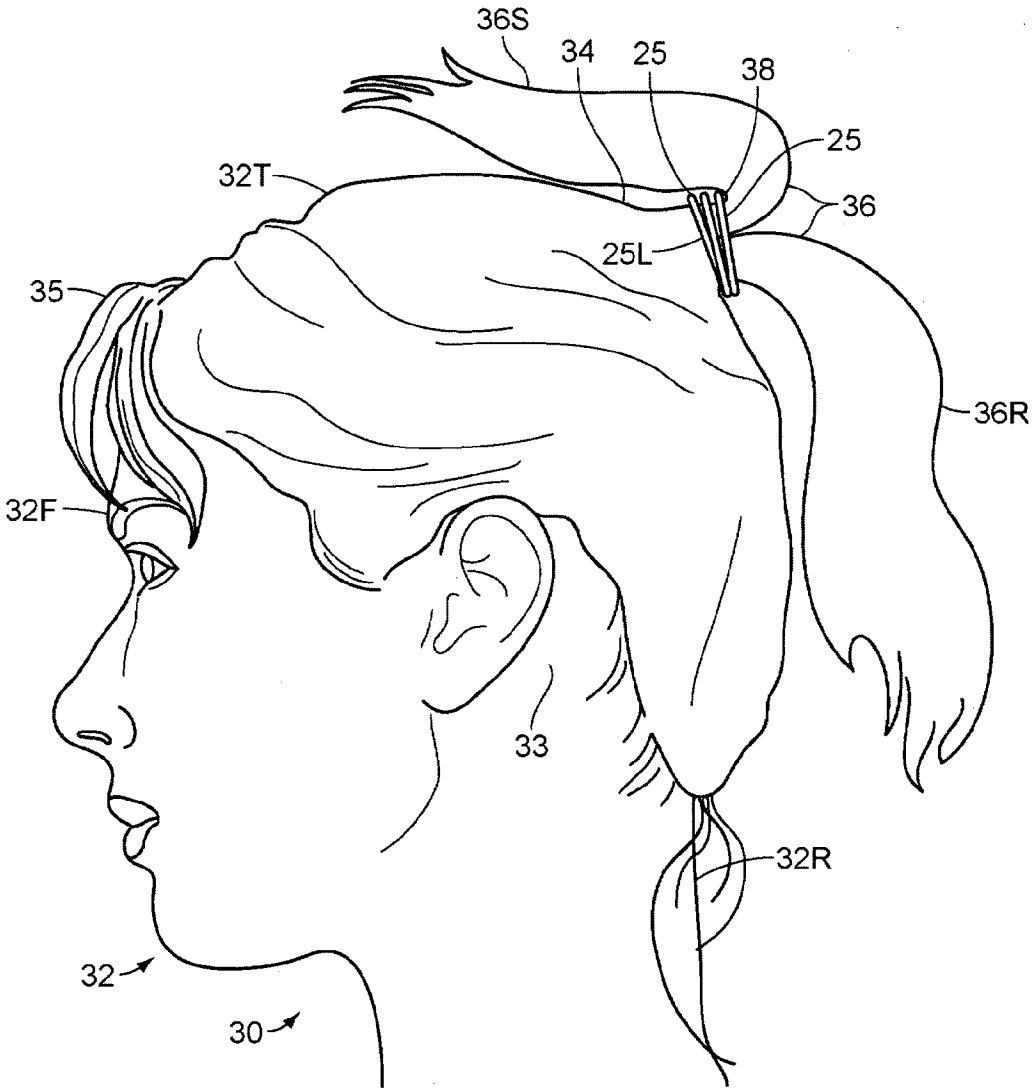
FIG. 4 is a side elevational view, illustrating a person about to use the present invention, wherein the ponytail has been bound using a tie, dividing the ponytail from the root portion, and wherein the ponytail has been divided into a selected portion, which is inverted to extend forwardly, and a remainder portion which drapes downward from the tie.

FIG. 4 illustrates a person 30, having a head 32, having a front 32F, top 32T, and rear 32R, a scalp 33 and hair 35 growing from the scalp 33. The hair is obviously made up of thousands of individual strands growing longitudinally from the scalp 33, which may be gathered together in groups as desired. In particular, and for the purposes of the present invention, the hair 35 has been grouped together at a root portion 34, close to the scalp 33 near the top 32T and rear 32R of the head, and is joined using a tie 25 which thereby defines a ponytail 36 rearward of the tie 25 and separates the root portion 34 from the ponytail. To reiterate for purposes of defining terminology: the root portion 34 may be considered that portion of the grouping of hair 35 which extends between the scalp 33 and the tie 25; and the ponytail 36 may be considered that portion which extends rearward of the tie 25.

Further illustrated in FIG. 4, the hair 35 of the ponytail 36 itself has been apportioned and divided just rearward of the tie into a selected portion 36S and a remainder portion 36R. Generally this split is made horizontally, whereas the selected portion 36S is an upper group or portion of the hair 35 protruding rearwardly from the tie 25 (the ponytail 36), and the remainder portion 36R is a lower group or portion of the hair 35 protruding rearwardly from the tie 25 (the ponytail 36). The remainder portion 36R drapes naturally rearwardly and downwardly from the tie 25. The tie itself extends circumferentially around the hair, transverse to the hair and thereby defines a theoretical lateral surface 25L, which extend transverse to the hair, cross-sectionally therethrough.

Still referring to FIG. 4, the selected portion 36S has been inverted just rearward of the tie 25, such that selected portion 36S is bent over the tie 25 so that it extends forwardly over the tie 25 and beyond, toward the front 32F of the head 32. The selected portion 36S is inverted at a first bend 38, which is substantially one hundred eighty degrees.

Figure 5:
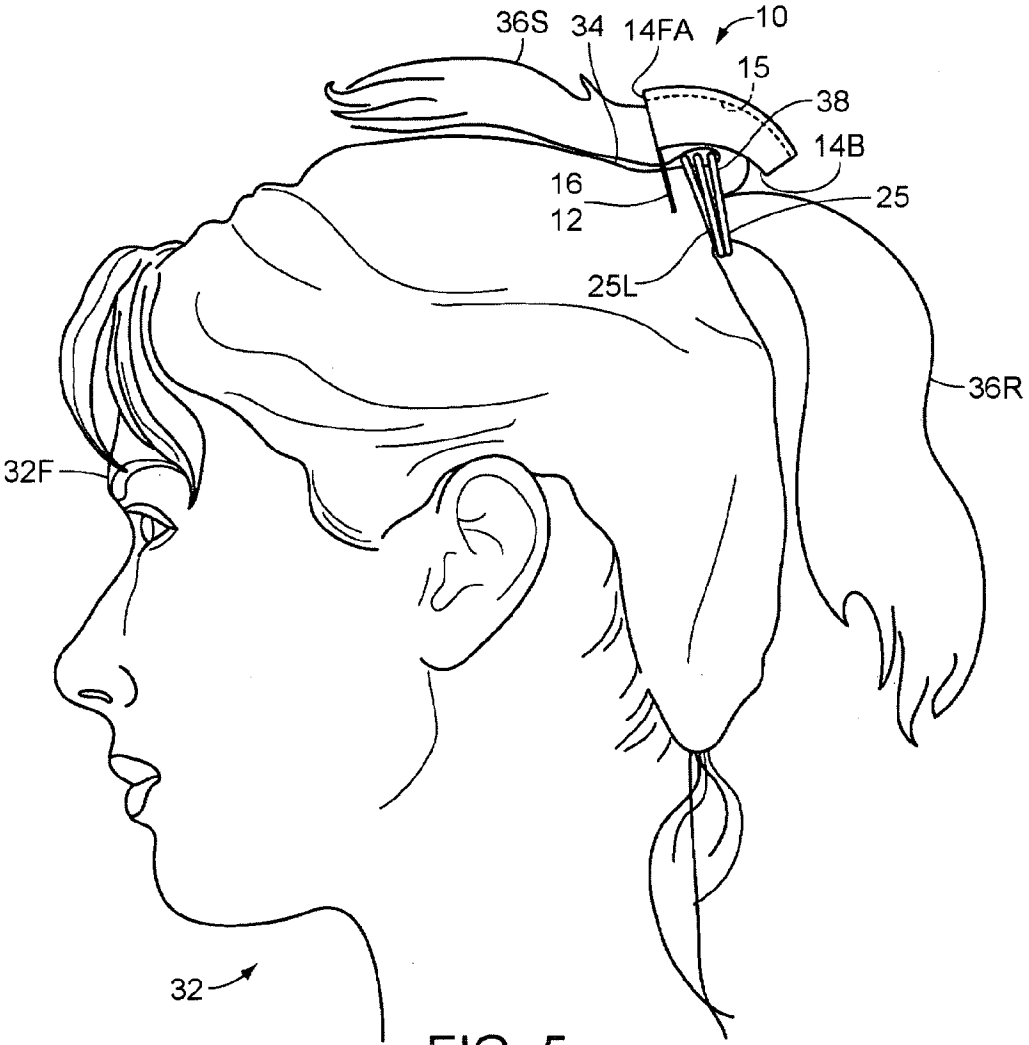
FIG. 5 is a side elevational view, wherein the teeth of the ponytail enhancing device are being inserted through the inverted selected portion and into the root portion to secure within the root portion and hold the inverted selected portion downward thereagainst.
Figure 6:
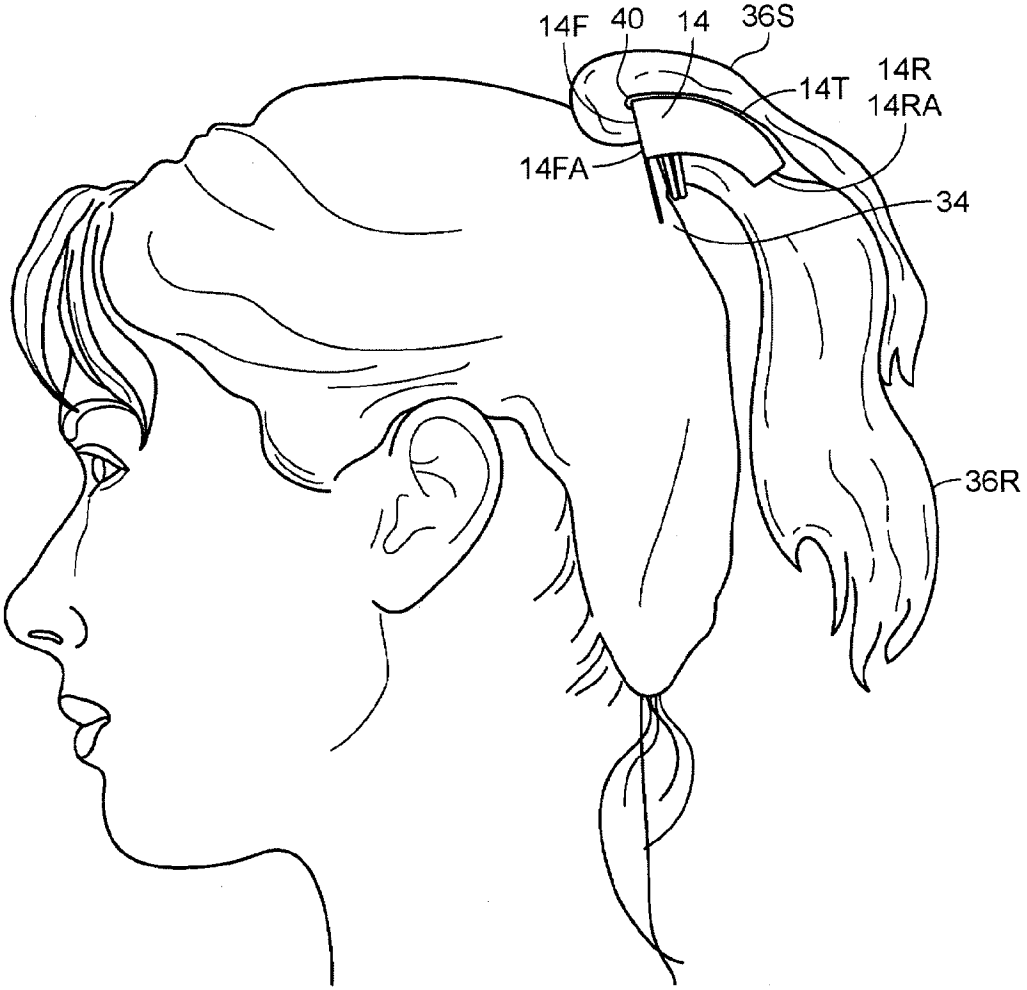
FIG. 6 is a side elevational view, wherein the selected portion is folded rearwardly over the front arch to extend rearwardly over the roof of the device.
Figure 7:
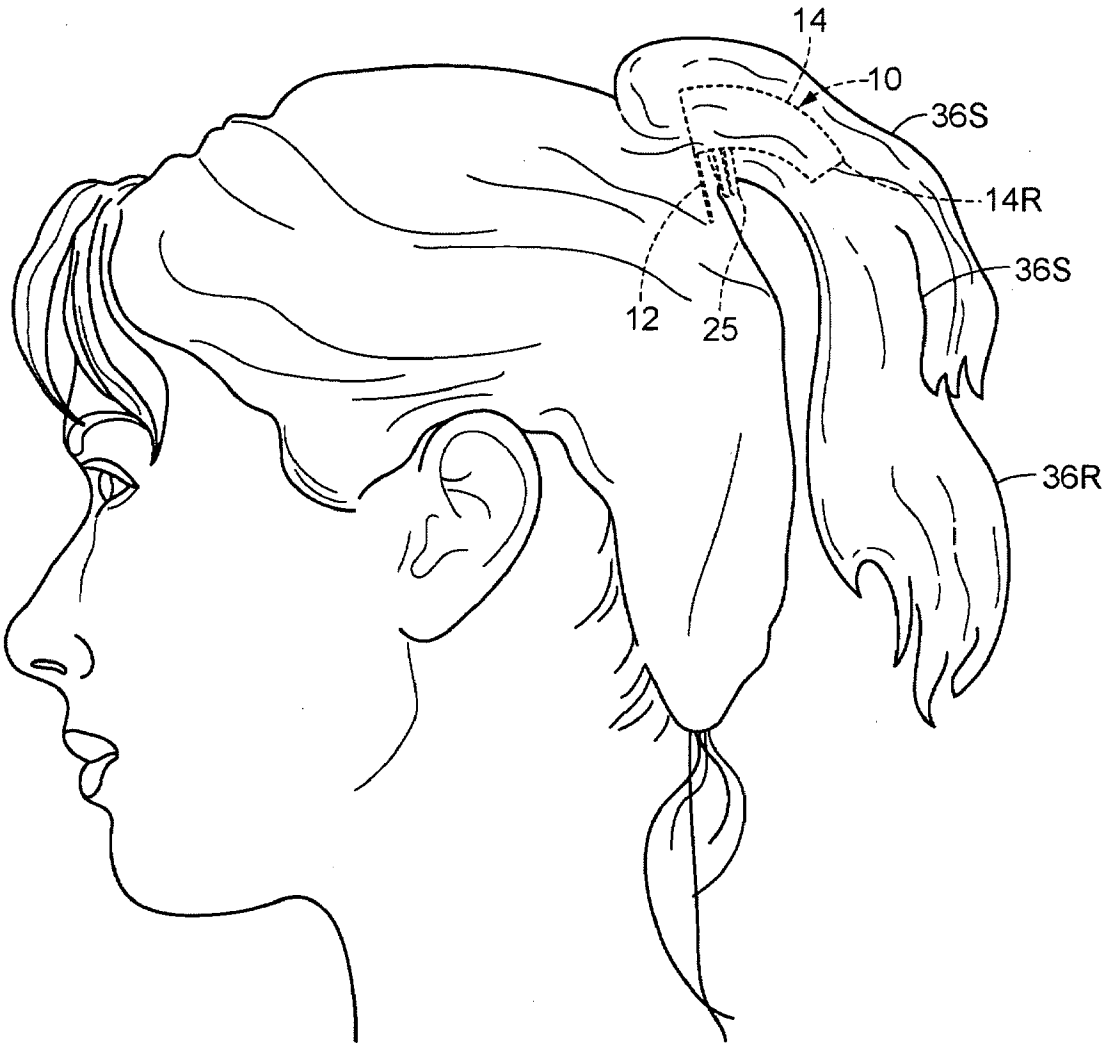
FIG. 7 is a side elevational view, wherein the selected pony tail has been spread across the forward arch, drapes over the roof, and conceals the device and the tie.

In FIG. 5, the inverted selected portion 36S has been secured against the tie 25 and against the root portion 34 with the ponytail enhancing device 10. In particular, the front 14F of the roof portion 14 is oriented toward the front 32F of the head 32, and the teeth 16 of the comb 12 are inserted downward through the inverted selected portion 36S and then into the root portion 34 immediately forward of the tie 25, transversely thereto and substantially parallel to the lateral surface 25L of the tie, whereby the teeth 16 anchor the device 10 within the generally dense root portion 34—which is particularly dense immediately adjacent to the tie 25. The inverted selected portion 36S at the first bend 38 is held against the tie 25, and against the root portion 34 by the roof portion 14 adjacent to the forward arch 14FA, whereas the bottom 14B of the roof portion 14 presses the inverted selected portion 36S adjacent the first bend 38 downward against the remainder portion 36R, and conceals the first bend 38 fully therebeneath, within the channel 15 as seen in FIG. 6.

The roof portion 14 of the device 10 is pressed downward as closely against the ponytail remainder portion 36R as possible, such that the roof portion 14 curves laterally around the ponytail remainder portion 36R, which exits at the roof portion rear 14R, partially extending through the rear arch 14RA. Once the device is firmly anchored within the root portion 34, the inverted selected portion 36S is once again bent at a substantially one hundred eighty degree angle at the forward arch 14FA, creating a second bend 40 in the selected portion 36S, and thereby the selected portion 36S once again extends rearwardly from said second bend 40, longitudinally over the top 14T of the roof portion 14 between the forward end 14F and rear 14 thereof, and then extending atop and substantially parallel with the remainder portion 36R. Once so positioned, the selected portion 36S is spread out laterally across the roof portion 14, so that, referring to FIG. 7, the selected portion 36S conceals the roof portion 14, the comb 12, and even the tie 25, and the selected portion 36S is blended with the remainder portion 36R rearward of the rear 14R of the roof portion 14. Thus, the device 10 is substantially invisible when in use, yet the enhancement created to the ponytail thereby is undeniable.

In conclusion, herein is presented a system for enhancing a ponytail by securely lifting a selected portion of the ponytail, concealing itself therebeneath, and than naturally blending with the remaining ponytail. Accordingly, the system provides an enhanced, elevated, and fuller appearance for the ponytail. The invention is illustrated by example in the foregoing description and in the accompanying drawings. Numerous variations are possible while adhering to the inventive concept. Such variations are contemplated as being a part of the present invention.

What is claimed is:

1. A method of enhancing a ponytail, for use by a user having a head having a front and rear, a scalp, and hair growing from a scalp which is grouped and bound by a tie to from the ponytail, the tie separating a root portion which is adjacent to the scalp from the pony tail which extends rearwardly from the tie, further using a device having a roof portion and a comb, the roof portion having a front and rear, front and rear arches thereat, and defining a channel between the front and rear, the comb located at the front and having a plurality of teeth extending substantially parallel to the front, comprising the steps of:

apportioning the hair of the ponytail into a selected portion and a remainder portion;

inverting the selected portion at a first bend just rearward of the tie so that the selected portion extends forwardly from the first bend across the tie and along the root portion;

anchoring the device in the root portion by inserting the comb downward through the inverted selected portion and into the root portion immediately adjacent to the tie;

inverting the selected portion forward of the comb at a second bend;

extending the selected portion from the second bend, atop the roof portion and atop the remainder portion.

2. The method of enhancing a ponytail as recited in claim 1, wherein the step of inserting the comb downward further comprises pressing the roof portion downward upon the first bend to maintain said first bend.

3. The method of enhancing a ponytail as recited in claim 2, wherein the step of inserting the comb downward further comprises pressing the roof portion downward upon the remainder portion rearward of the first bend such that the remainder portion partially exits rearwardly through the rear arch.

4. The method of enhancing a ponytail as recited in claim 3, wherein the steps as recited are followed by the step of concealing the device by spreading laterally the hair extending over the roof portion.

5. The method of enhancing a ponytail as recited in claim 4, wherein the device is curved downward between the front and rear arches, and wherein the step of extending the selected portion from the second bend atop the roof portion further comprises extending the selected portion rearward and downward upon the roof portion top, substantially between the front and rear arches.

6. The method of enhancing a ponytail as recited in claim 5, wherein the tie is a ring defining a lateral side transverse to the hair, and wherein the step of inserting the comb downward through the inverted selected portion and through the root portion immediately adjacent to the tie further comprises extending the comb parallel to the lateral side.

7. A method of creating an enhanced ponytail, for use by a user having a head having a front and rear, a scalp, and hair growing longitudinally using a tie, and further using an enhancing device having a roof portion and a comb, the roof portion having a front and rear, front and rear arches thereat, and defining a channel between the front and rear, the comb located at the front and having a plurality of teeth extending substantially parallel to the front, comprising the steps of:

grouping a portion of the hair growing from the scalp near the head rear;

creating a ponytail and a root portion by binding the hair with a tie extending substantially transverse to the hair and circumferentially therearound, the ponytail extending rearwardly from the tie and the root portion extending between the scalp and tie;

apportioning the hair of the ponytail into an upper selected portion and a lower remainder portion;

inverting the selected portion at a first bend just rearward of the tie so that the selected portion extends forwardly from the first bend across the tie and along the root portion;

anchoring the comb downward through the inverted selected portion and into the root portion immediately adjacent to the tie;

inverting the selected portion forward of the comb at a second bend; and extending the selected portion from the second bend, atop the roof portion and atop the remainder portion.

8. The method of creating an enhanced ponytail as recited in claim 7, wherein the tie is a ring defining a lateral side transverse to the hair, and wherein the step of inserting the comb downward through the inverted selected portion and through the root portion immediately adjacent to the tie further comprises extending the comb parallel to the lateral side of the ring.

9. The method of creating an enhanced ponytail as recited in claim 8, wherein the step of inserting the comb downward further comprises pressing the roof portion downward upon selected portion at the first bend.

10. The method of creating an enhanced ponytail as recited in claim 9, wherein the step of inserting the comb downward further comprises pressing the roof portion downward upon the remainder portion rearward of the first bend such that the remainder portion partially exits rearwardly through the rear arch.

11. The method of creating an enhanced ponytail as recited in claim 10, wherein the steps as recited are followed by the step of concealing the device by spreading laterally the hair extending over the roof portion.

12. The method of creating an enhanced ponytail as recited in claim 11, wherein the device is curved downward between the front and rear arches, and wherein the step of extending the selected portion from the second bend atop the roof portion further comprises extending the selected portion rearward and downward upon the roof portion top, substantially between the front and rear arches.

13. The method creating an enhanced ponytail as recited in claim 12, wherein the enhancing device has a pair of outer lower edges extending fully between the arches and an apex extending substantially equidistant between the outer lower edges and extending between the front and rear arches, wherein the outer lower edges are tapered inward so that the rear arch is shallower than the front arch such that the channel is deeper at the front arch such that the previously recited step of pressing the roof portion downward upon the selected portion at the first bend further comprises containing the selected portion at the first bend within the channel beneath the roof near the front arch.

* * * * *